US006494450B2

(12) United States Patent
Tsurumaki

(10) Patent No.: US 6,494,450 B2
(45) Date of Patent: Dec. 17, 2002

(54) PAPER DISCHARGE BASE OF IMAGE FORMING APPARATUS

(75) Inventor: Takeshi Tsurumaki, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 79 days.

(21) Appl. No.: 09/769,732

(22) Filed: Jan. 26, 2001

(65) Prior Publication Data

US 2001/0010193 A1 Aug. 2, 2001

(30) Foreign Application Priority Data

Jan. 31, 2000 (JP) ..... 2000-022344
Jan. 31, 2000 (JP) ..... 2000-022345

(51) Int. Cl.[7] ..... B65H 31/20
(52) U.S. Cl. ..... 271/224; 271/220
(58) Field of Search ..... 271/224, 220, 271/221, 222, 207, 184

(56) References Cited

U.S. PATENT DOCUMENTS 3,907,128 A * 9/1975 Cathers ..... 271/224
5,332,210 A * 7/1994 Silverberg et al. ..... 271/220
5,432,230 A * 7/1995 Vanderbilt et al. ..... 525/166
5,931,461 A * 8/1999 Xu ..... 271/182
6,354,588 B1 * 3/2002 Kuwahara et al. ..... 271/224

* cited by examiner

*Primary Examiner*—H. Grant Skaggs
(74) *Attorney, Agent, or Firm*—Kanesaka & Takeuchi

(57) ABSTRACT

A paper discharge base is applied with a sponge sheet as a damping plate of an impact wall. A protection sheet is pasted on a surface of the sponge sheet. When the damping plate is impacted by a print sheet, the impact force is transmitted from the protection sheet to the sponge sheet and is damped by the sponge sheet. Further, the sponge sheet is protected by the protection sheet and therefore, the sponge sheet is not destructed by the impact of the print sheet.

5 Claims, 18 Drawing Sheets

PAPER DISCHARGE BASE OF IMAGE FORMING APPARATUS

BACKGROUND OF THE INVENTION AND RELATED ART STATEMENT

The present invention relates to a paper discharge base of an image forming apparatus such as a copying apparatus or a printing apparatus for retaining a print sheet discharged from a printing section of an image forming apparatus in a stacked state.

With high speed formation of an image forming apparatus such as a copying apparatus or a printing apparatus in recent years, a print sheet discharged from a printing section thereof is discharged at high speed toward a paper discharge base and is impacted to an impact wall of the paper discharge base with large momentum. In this case, when the impact wall is of a rigid structure, there is a drawback that a large impact sound is emitted in impacting the print sheet.

Hence, there is disclosed a paper discharge base for alleviating an impact sound of a print sheet in Japanese Patent Laid-Open No. 183553/1997. Such a paper discharge base is provided with a paper mounting floor and an impact wall. The main body of the impact wall is attached with an impact wall plate impacted by a print sheet via an elastic film. Therefore, according to the paper discharge base, impact force when a print sheet is impacted to the impact wall plate is damped by the elastic film and the impact sound is alleviated.

However, the impact wall plate impacted by a print sheet is made of foamed styrene or foamed polyvinyl chloride. Since the print sheet is directly impacted to the impact wall plate at high speed, there is a drawback that the impact wall plate is gradually impaired by the impact force after long hours of use.

Further, since the impact wall of the paper discharge base needs a mechanism of expanding the elastic film, there also is a drawback that the structure of the impact wall becomes complicated.

Further, depending on paper quality of a print sheet, when a print sheet is not impacted to an optimum position of the impact wall plate, the print sheet loaded on the paper mounting floor does not align neatly.

Further, the height of a print sheet impacted to the impact wall plate differs by paper quality (weight) of a print sheet. In case of a heavy print sheet, the height of impact is low and in case of a light print sheet, the height of impact becomes high.

Therefore according to the paper discharge base disclosed in the publication, a print sheet is not impacted to an optimum position of the impact wall plate depending on the paper quality of the print sheet owing to a difference in the height of impact caused by the paper quality (weight) of the print sheet as described above. Therefore, there is a drawback that the impact cannot be damped effectively.

SUMMARY OF THE INVENTION

The present invention has been carried out in order to resolve the above-described drawbacks of the conventional technology. It is an object thereof to effectively damp impact of a print sheet discharged from a printing section. Particularly, it is an object thereof to promote durability against impact of a print sheet.

Further, it is another object thereof to further promote strength of a surface of a damping member and damping operation of the damping member. Further, it is an object thereof to smoothly drop a print sheet along the surface of the damping member in accordance with property of the surface.

Further, it is another object thereof to excellently align a print sheet which is impacted to a damping member and drops.

It is still another object thereof to alleviate impact sound of a print sheet and spring back of the print sheet caused by impact.

Further, it is another object thereof to gradually reduce kinetic energy of a print sheet impacted to a surface of a damping member. Further, it is an object thereof to effectively prevent spring back of a print sheet caused by a damping member thereby.

It is still another object thereof to achieve further sound pacifying formation of an impact sound of a print sheet by a simple constitution. Further, it is an object thereof to further alleviate spring back of a print sheet caused by impact and excellently align a sheet.

Particularly, it is an object thereof to make a damping member further easy to escape in the direction of discharging a print sheet (space portion side) and drop a print sheet impacted to a damping member further in a constant direction along a surface of the damping member.

Further, it is another object thereof to dispose a damping member at a position capable of damping effectively an impact of a print sheet in correspondence with a paper quality of the print sheet.

It is still another object thereof to be capable of adjusting a position of the damping member such that the impact of the print sheet can effectively be damped in correspondence with the paper quality of the print sheet.

In order to achieve the above-described object, according to the first aspect of the present invention, there is provided a paper discharge base of an image forming apparatus including an impact wall 70 impacted by print sheet P discharged from a printing section, a damping member 78 provided at an impact position of the impact wall 70, and a paper mounting floor 72 loaded with the print sheet P which is impacted to the damping member 78 and drops, wherein the damping member 78 is constituted by a sponge sheet 84 and a protection sheet 86 attached to a surface of the sponge sheet 84 impacted by the print sheet P.

According to the first aspect of the present invention, when the print sheet P is impacted to the damping member 78, the impact force is transmitted from the protection sheet 86 to the sponge sheet 84 and is damped by the sponge sheet 84. Further, the impact sound is alleviated. The sponge sheet 84 is protected by the protection sheet 86 and accordingly, durability against impact of the print sheet P is promoted.

According to the second aspect of the present invention, there is provided the paper discharge base according to the paper discharge base of an image forming apparatus of the first aspect, in which the protection sheet 86 of the damping member 78 is made of polyethylene terephthalate.

According to the second aspect, by applying a film made of polyethylene terephthalate having high strength, damping operation of the sponge sheet 84 is promoted by thinning the protection sheet 86 and the sponge sheet is protected sufficiently against the impact force of the print sheet P. Further, the film made of polyethylene terephthalate is provided with a property in which a surface thereof is smooth. Therefore, the print sheet P impacted to the protection sheet 86 is made to drop smoothly along the surface of the protection sheet 86.

According to the third aspect of the present invention, there is provided the paper discharge base of an image forming apparatus according to the paper discharge base of an image forming apparatus of the first or the second aspect, further including regulating faces 80 projected from a portion of the damping member 78 on a lower side of an impact position thereof to a side of an apparatus main body 14 on both sides of the impact wall 70 formed on the lower side of the impact position at which the print sheet P is impacted to the damping member 78 for leading a front end edge portion of the dropping print sheet P to the lower side while being brought into sliding contact therewith.

According to the third aspect, the print sheet P impacted to the surface of the damping member 78 drops by its own weight. The print sheet drops slidingly in a state in which the front end edge portion is being brought into contact with the surface of the damping member 78. Further, when the print sheet P slidingly drops to a position of a lower end portion 78B of the damping member 78, both ends of the front end edge portion of the print sheet P are brought into sliding contact with the regulating faces 80. Further, the print sheet P is successively stacked on the paper mounting floor 72 in a state in which the front end edge portion is aligned and contained.

According to the fourth aspect of the present invention, there is provided the paper discharge base of an image forming apparatus according to the paper discharge base of an image forming apparatus according to any one of the first through the third aspects, in which the damping member 78 includes a space portion 92 on a rear face side of the impact position of the print sheet P.

According to the four the aspect of the present invention, when the print sheet P is impacted to the damping member 78, by the impact force, the damping member 78 is elastically deformed to escape in a direction of discharging the print sheet P constituting a side of the space portion 92. Thereby, both of the impact sound of the print sheet P and spring back of the print sheet P caused by impact are alleviated.

According to the fifth aspect of the present invention, there is provided the paper discharge base of an image forming apparatus according to the paper discharge base of an image forming apparatus of the fourth aspect, in which the lower end portion 78B of the damping member 78 is provided in the direction of discharging the print sheet P relative to an upper end portion 78A of the damping member 78.

According to the fifth aspect of the present invention, a surface of the damping member 78 is formed in a shape of a gradually curved face inclined in the direction of discharging the print sheet P gradually from the upper end portion 78A to the lower end portion 78B. The print sheet P impacted to the surface of the damping member 78 drops along the curved face of the damping plate 78 while being directed to the discharge direction along the curved surface of the damping plate 78, that is, while kinetic energy of the print sheet P is being gradually reduced and led to the regulating portions 80. The print sheet p is smoothly stacked onto the paper mounting floor 72 by preventing spring back caused by the damping plate 78.

According to the sixth aspect of the present invention, there is provided the paper discharge base of am image forming apparatus according to the paper discharge base of an image forming apparatus according to the fifth aspect, in which either one of the upper end portion 78A and the lower end portion 78B of the damping member 78 is fixed to a side of the impact wall 70 and the other thereof is held slidably in up and down directions relative to the side of the impact wall 70.

According to the sixth aspect of the present invention, in case the upper end portion 78A (lower end portion 78B) is fixed, when the print sheet P is impacted to the damping member 78, the damping member 78 is elastically deformed in the discharge direction and the lower end portion 78B (upper end portion 78A) is lifted (lowered). Thereby, the damping plate 78 becomes easy to escape in the direction of discharging the print sheet P constituting the side of the space portion 92. Further, the position of the lower end portion 78B (upper end portion 78A) of the damping plate 78 is held by a receive portion 88B and accordingly, the print sheet P impacted to the damping plate 78 drops in a constant direction along the surface of the damping member 78.

According to the seventh aspect of the present invention, there is provided the paper discharge base of an image forming apparatus according to the paper discharge base of an image forming apparatus of any one of the fourth through the sixth aspects, further including position adjusting means 94 provided at the impact wall 70 and capable of adjusting the position of the damping member 78 in the up and down directions.

According to the seventh aspect of the present invention, the damping member 78 is freely disposed at a position of effectively damping impact of the print sheet P in correspondence with paper quality of the print sheet P.

According to the eighth aspect of the present invention, there is provided the paper discharge base of an image forming apparatus according to the paper discharge base of an image forming apparatus of the seventh aspect, in which the position adjusting means 94 includes a click mechanism for positioning the position of the damping member 78 in the up and down directions to a predetermined position.

According to the eighth aspect of the present invention, the damping member 78 is freely positioned to a position of effectively damping impact of the print sheet P in correspondence with a paper quality of the print sheet P having a predetermined paper quality.

DETAILED DESCRIPTION OF THE PREFERRED EMBODIMENTS

A detailed explanation will be given to the first embodiment of a paper discharge base of an image forming apparatus according to the present invention in reference to attached drawings as follows.

Figure 1:
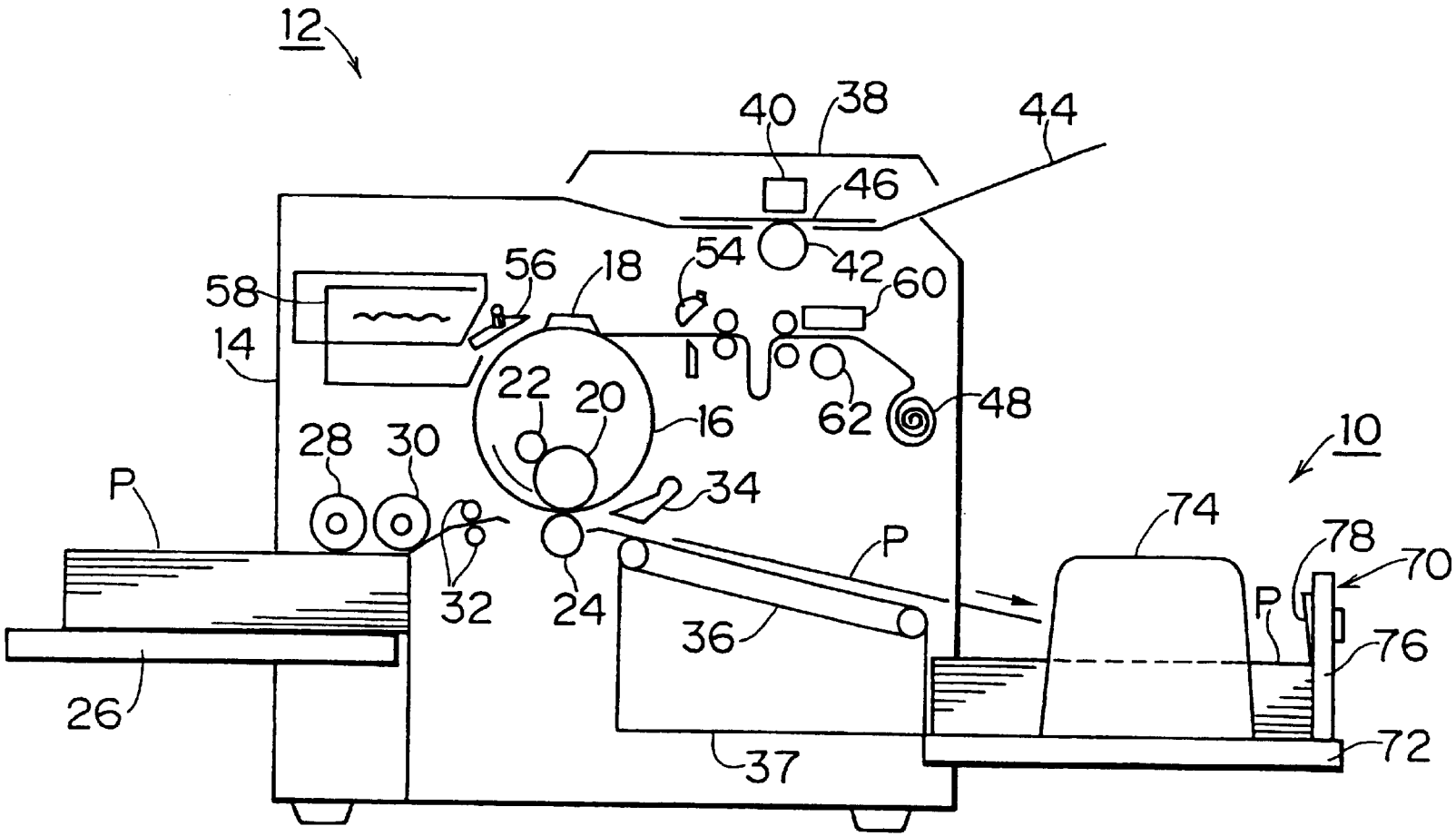
FIG. 1 is a view of an inner structure of a stencil printing machine to which a paper discharge base according to the present invention is applied.

FIG. 1 is a view of an inner structure of a stencil printing machine as an image forming apparatus to which a paper discharge base 10 according to the embodiment of the present invention is applied.

At an inner portion of a main body 14 of the stencil printing machine 12, there is arranged a printing drum 16 constituted by a cylindrical shape rotatably around an axis line of its own. At an outer peripheral face of the printing drum 16, there is provided a clamp member 18 for clamping an end portion of a stencil sheet 48, mentioned later. The stencil sheet 48 pinched by the clamp member 18 is wound to set to the outer peripheral face of the printing drum 16 by rotating the printing drum 16 in the counterclockwise direction of FIG. 1.

At the inner portion of the printing drum 16, there are arranged a squeegee roller 20 in contact with an inner peripheral face thereof and a doctor roller 22 arranged to the squeegee roller 20 with a very small interval therebetween. Between the squeegee roller 20 and the doctor roller 22, ink supplied from an ink supply source, not illustrated, forms an ink store portion in a shape of a wedge. Ink at the ink store portion is supplied to the inner peripheral face of the printing drum 16 while being measured by passing through the very small interval by rotating the squeegee roller 20 in the counterclockwise direction of FIG. 1.

Right under the printing drum 16, there is arranged a press roller 24. The press roller 24 is arranged at a position opposed to the squeegee roller 20. Further, the press roller 24 is provided liftably to be brought into contact with and separated from the outer peripheral face of the printing drum 16.

At a left side face of the main body 14 in FIG. 1, there is provided a sheet supply base 26 loaded with print sheets P. On an upper side of the paper discharge base 26, there are provided a scraper roller 28 and a pickup roller 30. The scraper roller 28 and the pickup roller 30 feed the print sheet P stacked on the sheet supply base 26 sheet by sheet to between the printing drum 16 and the press roller 24.

Further, a pair of upper and lower timing rollers 32 is provided contiguously to the pickup roller 30. The print sheet P fed by the scraper roller 28 and the pickup roller 30 is accurately fed by the timing rollers 32 at timings in cooperation with operation of the printing drum 16 and the press roller 24. Further, one-way clutches are built in the scraper roller 28 and the pickup roller 30. Further, when the print sheet P is transferred by the timing rollers 32, the scraper roller 28 and the pickup roller 30 are driven to follow by the print sheet P.

On a right side of the printing drum 16 in FIG. 1, there are provided a sheet separator claw 34, a transfer belt 36 and a suction unit 37. After passing between the printing drum 16 and the press roller 32, the print sheet P is separated from the printing drum 16 by the sheet separator claw 34. The separated print sheet P is sucked to the transfer belt 36 by the suction unit 37. Thereafter, the print sheet P is discharged to the paper discharge base 10 by the transfer belt 36.

At an upper portion of the main body 14, there is provided a lid 38. A line image sensor 40 is attached to a rear side of the lid 38. At an upper face of the main body 14 opposed to the line image sensor 40, there is arranged a draft handling roller 42. An upper portion of the draft handling roller 42 is partially projected from the main body 14.

Further, a draft base 44 is mounted with a draft before reading. The draft 46 mounted on the draft base 44 is supplied between the draft handling roller 42 and the line image sensor 40 from an outer side of the lid 38 and image data of the draft is read.

At an inside of the main body 14, there is contained a stencil sheet roll 48 in a rotatable state. The stencil sheet 48 drawn from the stencil sheet roll passes between a thermal head 60 and a platen roller 62 arranged to be opposed thereto. Further, there is carried out perforation in accordance with the image data. Successively, the stencil sheet 48 is cut in a single sheet by a cutter 54 and thereafter, transferred to the clamp member 18 of the printing drum 16.

On a side of the printing drum 16 opposed to the cutter 54, there is provided a stencil separator claw 56. The stencil separator claw 56 separates a front end of the stencil sheet 48 which has been used by finishing printing operation and relieved of pinching of the clamp member 18, from the printing drum 16 in accordance with rotation of the printing drum 16. The stencil sheet 48 which has been separated from the printing drum 16by the stencil separator claw 56, is contained in a stencil disposal box 58.

The printing operation is started by starting the stencil printing machine 12. The print sheets P stacked on the paper supply base 26 are fed between the printing drum 16 and the press roller 24 sheet by sheet by the scraper roller 28 and the pickup roller 30. In accordance therewith, the printing drum 16 is rotated and the print sheet P is pressed between the printing drum 16 and the press roller 24 lifted at the predetermined timing. Thereby, ink oozed from the inner portion of the printing drum 16 by the stencil sheet 48 is transcribed onto the print sheet P and the printing operation is carried out. Further, the printed print sheet P is separated from the printing drum 16 by the sheet separator claw 34 and thereafter, successively discharged to the paper discharge base 10 by the transfer belt 36.

An explanation will be given to the paper discharge base 10 for mounting the printed print sheet P as follows.

Figure 2:
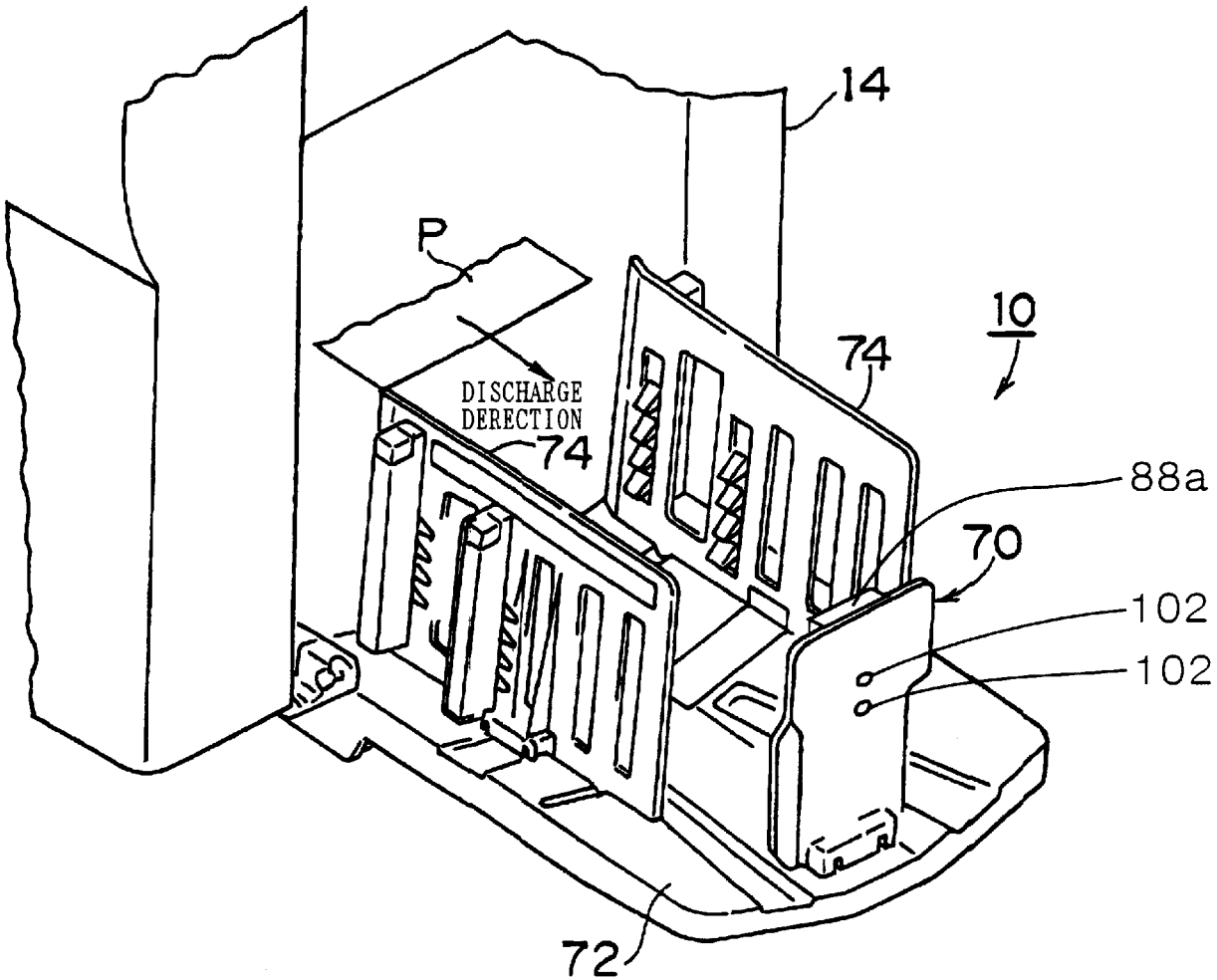
FIG. 2 is a perspective view of a paper discharge base according to the first embodiment.

As shown by FIG. 2, the paper discharge base 10 is constituted by an impact wall 70, a paper mounting floor 72 and a pair of fences 74. The impact wall 70 is for blocking advance of the discharged print sheet P and is impacted by the print sheet P discharged from the main body 14 of the stencil printing machine 12. The paper mounting floor 72 is stacked with the discharged print sheet P. The pair of fences 74 regulates positions of two side edges of the print sheet P.

Figure 3:
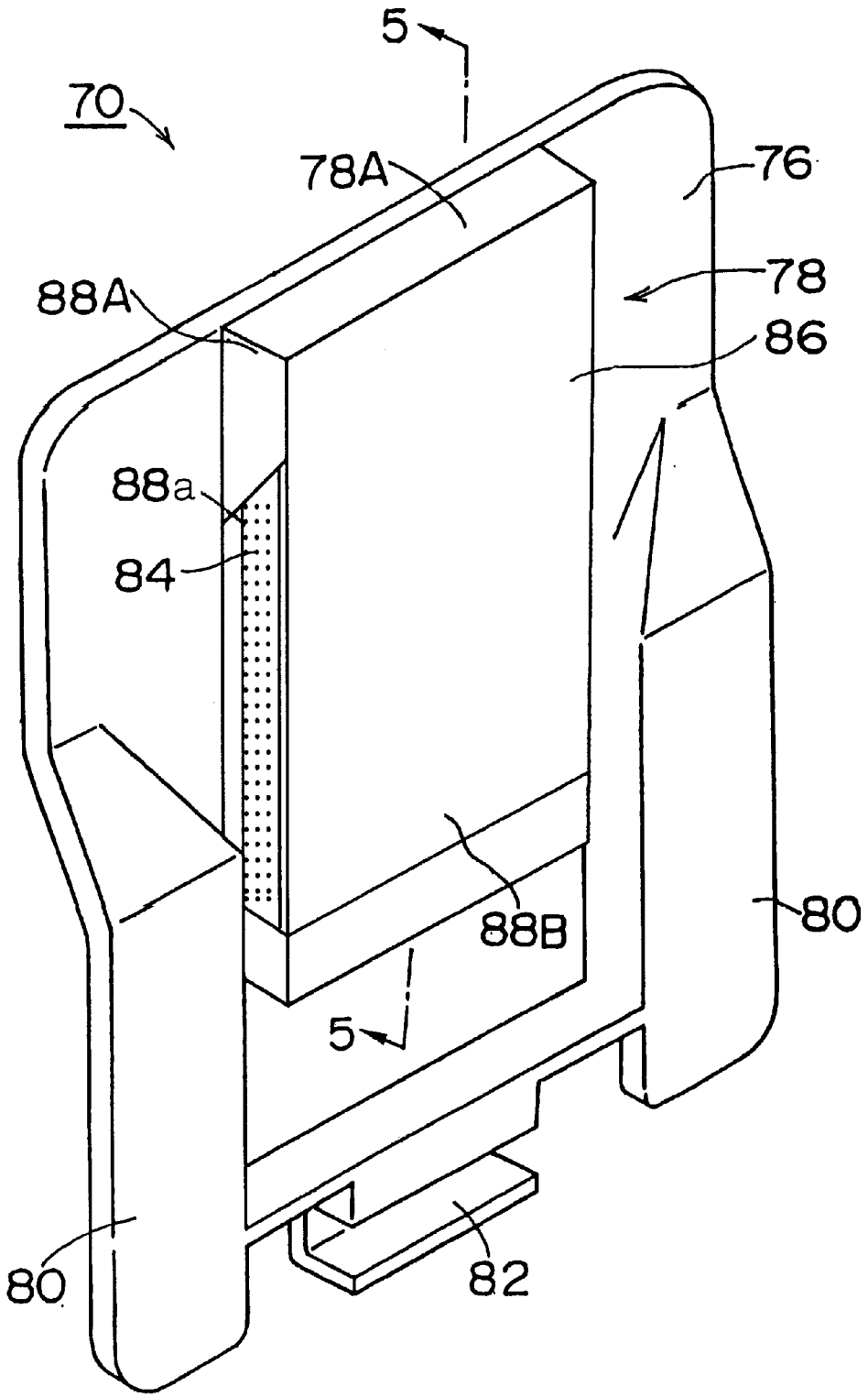
FIG. 3 is a front perspective view showing the paper discharge base according to the first embodiment.
Figure 4:
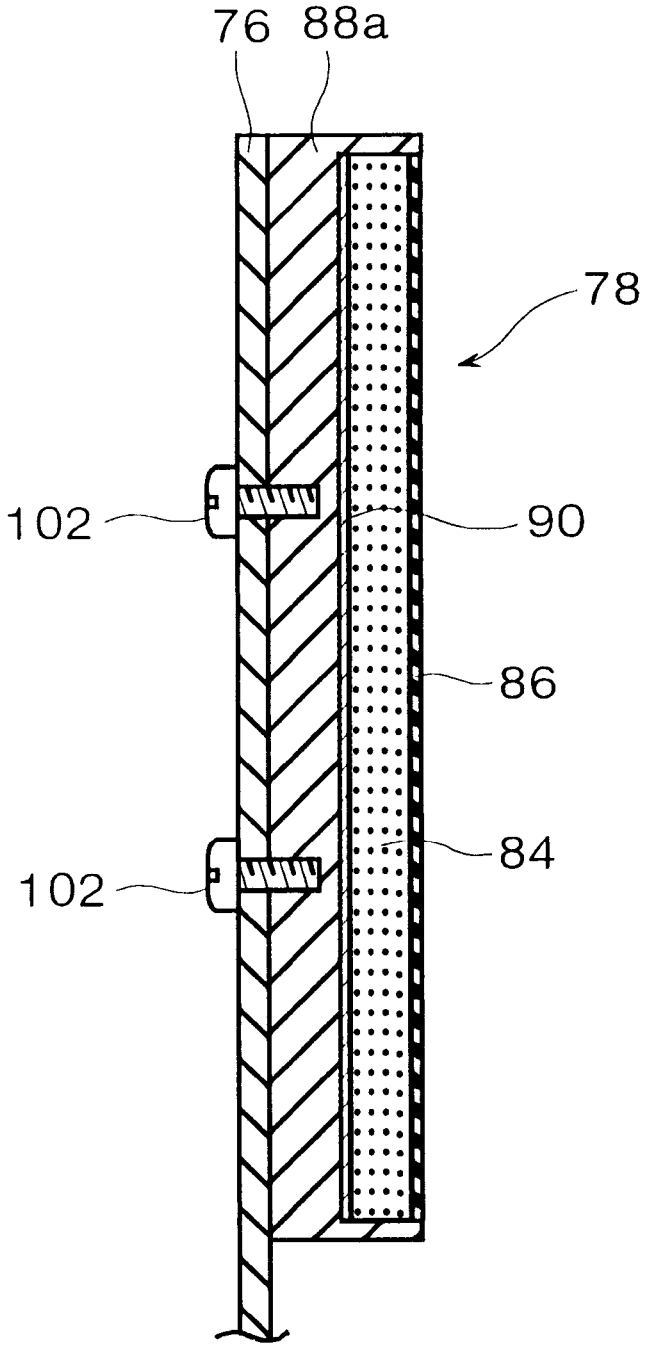
FIG. 4 is a sectional view of an impact wall taken along line 4—4 of FIG. 3.

As shown by FIG. 3 and FIG. 4, the impact wall 70 is constituted by an impact wall main body 76 and a damping plate (corresponding to damping member) 78. The impact wall main body 76 is formed substantially in a rectangular shape. At a lower edge portion of the impact wall main body 76, there is formed a fixing portion 82 to project therefrom to be erected from and fixed to the paper mounting floor 72. Further, in the impact wall main body 76, the damping plate 78 is attached to a substantially central portion of a face thereof for receiving the discharged print sheet P.

The damping plate 78 is constituted by a sponge sheet 84 and a protection sheet 86 covering a surface of the sponge sheet 84. The sponge sheet 84 is formed in a rectangular shape by a sheet made of, for example, soft foamed polyurethane. The protection sheet 86 is pasted on the surface of the sponge sheet 84 (face on a side impacted by the print sheet P). The protection sheet 86 has high strength and thinness and is fabricated by a film (commercial name: miler) made of polyethylene terephthalate having a property that a surface thereof is smooth. Further, the material of the protection sheet 86 is not limited to polyethylene terephthalate but there may be used a film made of other plastic or a film made of rubber.

As shown by FIG. 4, the damping plate 78 is held in a holding member 88*a*. A double face adhering tape 90 is pasted on a surface of the holding member 88*a*. A rear face of the sponge sheet 84 is pasted to the double face adhering tape. Upper and lower end edges of the holding member 88*a* are formed to project by an amount of thicknesses of the double face adhering tape 90, the sponge sheet 84 and the protection sheet 86, and support the damping plate 78. The holding member 88*a* is screwed to the impact wall main body 76 by screws 102.

Further, as shown by FIG. 3, the impact wall main body 76 is provided with regulating portions 80. The regulating portions 80 are formed at lower portions of both sides of the impact wall main body 76, that is, downward from an impact position for impacting the print sheet P to the damping plate 78. The regulating portions 80 are formed to sandwich the damping plate 78. The regulating portions 80 are formed to project from the impact wall main body 76 to the side of the apparatus main body 14.

The regulating face 80 as the regulating portion is a plane parallel with the impact wall main body 76 and is a plane orthogonal to a direction of discharging the print sheet P which has been printed and flown.

Further, as shown by FIG. 4, the regulating face 80 is projected slightly from the surface of the damping plate 78 to the side of the apparatus main body 14. Therefore, a surface 78B at a lower end portion of the damping plate 78 is formed to be substantially flush with the respective regulating faces 80. Therefore, the lower end portion surface 78B of the damping plate 78 and the regulating faces 80 are provided continuously smoothly.

Next, an explanation will be given to operation of the embodiment. First, before starting the printing operation, the paper discharge base 10 is installed at a predetermined position (position in FIG. 2) of the stencil printing machine 12. Further, the interval between the fences 74 is adjusted to be aligned with the width of the print sheet P and a position of the impact wall 70 in the forward and rearward directions is adjusted to be aligned with the length of the print sheet P.

The printed print sheet P is separated from the printing drum 16 by the sheet separator claw 34 and thereafter, successively discharged to the paper discharge base 10 by the transfer belt 36. The discharged print sheet P is flown and a front end edge portion thereof is impacted to the damping plate 78 of the impact wall 70.

At this occasion, impact of the print sheet P is transmitted from the protection sheet 86 to the sponge sheet 84 and is damped by he sponge sheet 84. The sponge sheet 84 is protected by the protection sheet 86 and accordingly, the sponge sheet 84 is not destructed by the impact of the print sheet P.

The impacted print sheet P drops by its own weight. At this occasion, the print sheet P rubbingly drops in a state in which the front end edge portion is being brought into contact with the surface of the protection sheet 16. Further, when the print sheet P rubbingly drops to the position of the lower end portion 78B of the damping plate 78, the both sides of the front end edge portion of the print sheet P are brought into sliding contact with the regulating faces 80. Further, the print sheets P are successively stacked on the paper mounting floor 72 in a state in which the front end edge portions are aligned and retained.

Further, as the protection sheet 86 of the damping plate 78, a film made of polyethylene terephthalate may be applicable. The film made of polyethylene terephthalate is provided with high strength. Therefore, even when the protection sheet 86 is thinned to promote damping operation of the sponge sheet 84, the sponge sheet 84 can sufficiently be protected against impact force of the print sheet P. Further, the film made of polyethylene terephthalate is provided with a property that a surface thereof is smooth. Therefore, the print sheet P impacted to the protection sheet 86 is made to drop smoothly along the surface of the protection sheet 86.

Figure 5:
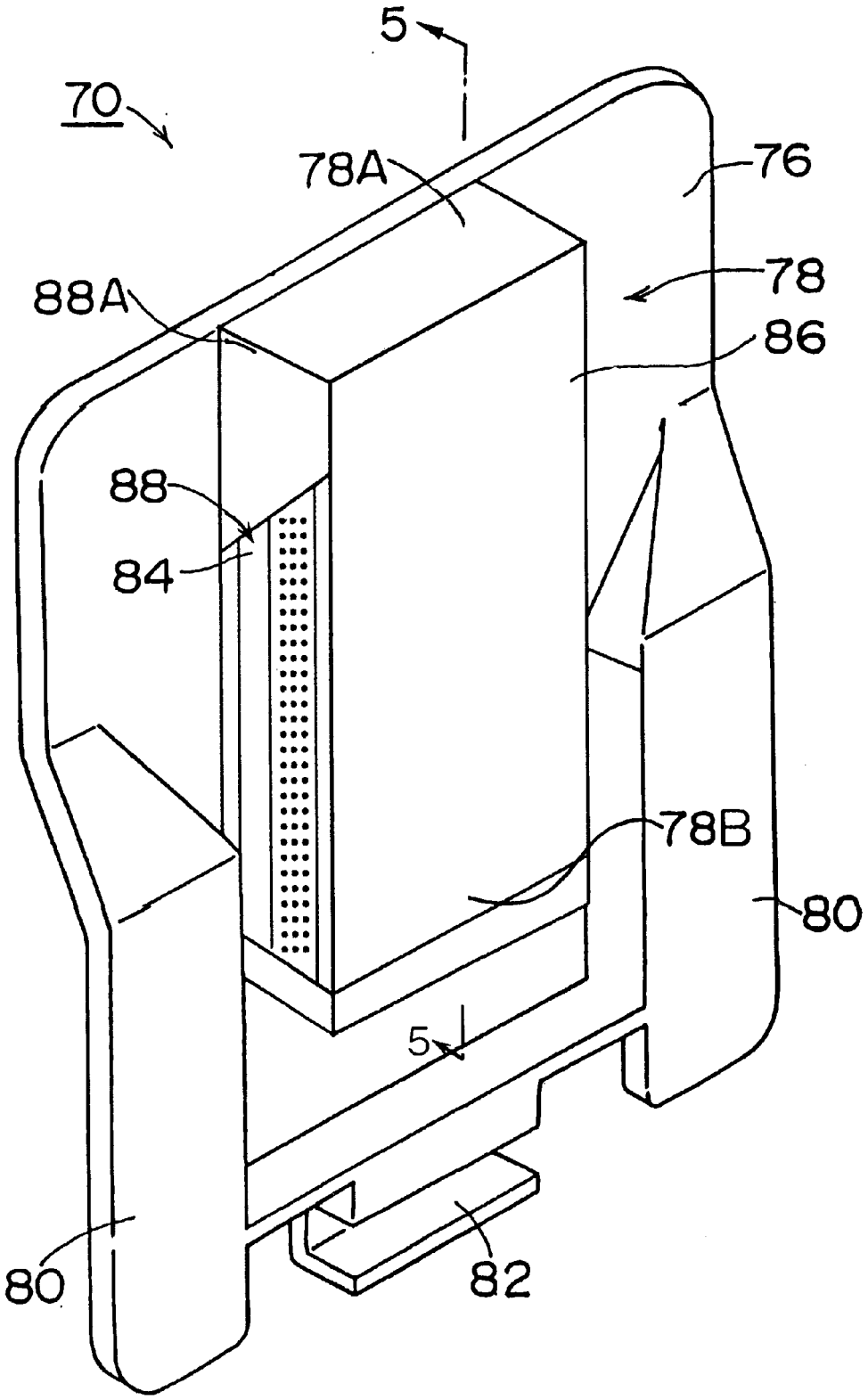
FIG. 5 is a front perspective view showing the paper discharge base according to the second embodiment and a front perspective view showing a state in which a damping plate is positioned at an upper position in a paper discharge base according to the second embodiment.
Figure 6:
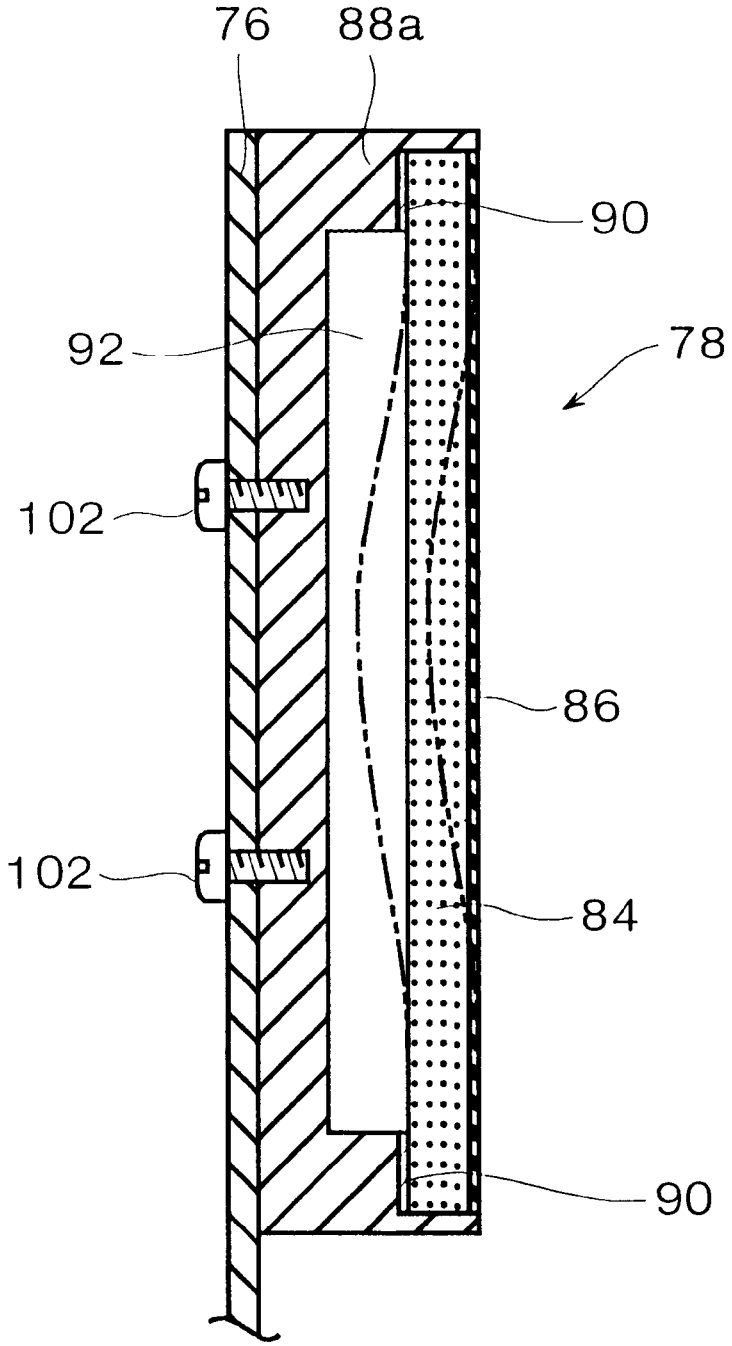
FIG. 6 is a sectional view of an impact wall taken along line 6—6 of FIG. 5.

Next, an explanation will be given to the second embodiment of the present invention. Portions same as those in the first embodiment are attached with the same notations and an explanation thereof will be omitted. As shown by FIG. 5 and FIG. 6, this example is an example in which a space portion 92 is formed on a rear face side of the damping plate 78 in the embodiment shown by FIG. 3 and FIG. 4.

In this case, when the print sheet P is impacted to the damping plate 78, by the impact force, as shown by two-dotted chain lines in FIG. 6, the damping plate 78 is elastically deformed to escape in a direction of discharging the print sheet P constituting the side of the space portion 92. Thereby, both of impact sound of the print sheet P and spring back of the print sheet P caused by impact are alleviated. Therefore, not only sound pacifying formation is achieved but also excellent sheet alignment can be carried out.

Figure 7:
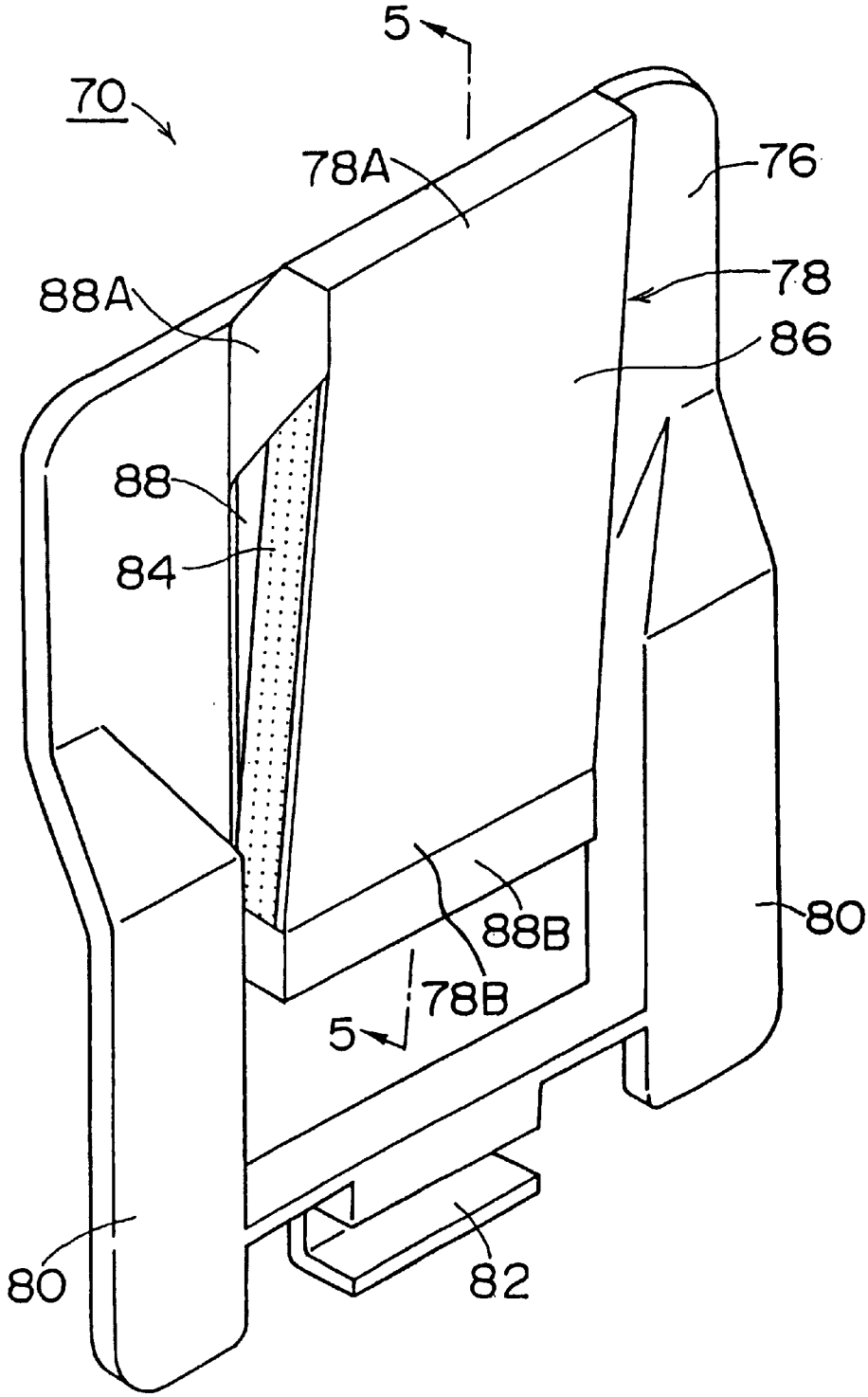
FIG. 7 is a front perspective view showing a modified example of the paper discharge base according to the second embodiment and a front perspective view showing a state in which a damping plate is positioned at an upper position in a modified example of the paper discharge base according to the second embodiment.
Figure 8:
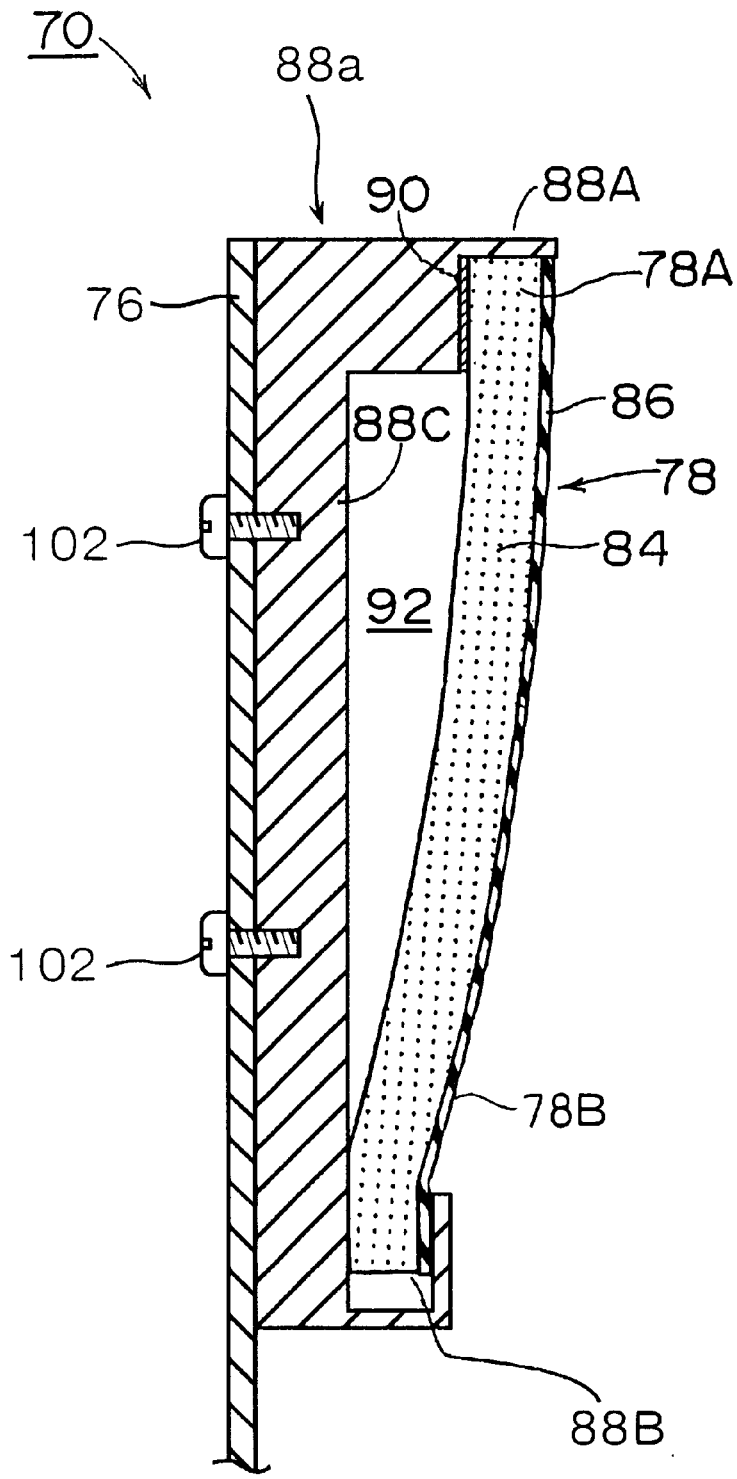
FIG. 8 is a sectional view of an impact wall taken along a line 8,9—8,9 of FIG. 7.

Further, as shown by FIG. 7 and FIG. 8, the lower end portion 78B of the damping plate 78 may be provided in the direction of discharging the print sheet P from an upper end portion 78A of the damping plate 78.

In this case, as shown by FIG. 7 and FIG. 8, the surface of the damping plate 78 is formed in a shape of a gradually curved face slightly inclined in the direction of discharging the print sheet P gradually from the upper end portion 78A toward the lower end portion 78B. When the surface of the damping plate 78 is formed in the shape of the curved face in this way, the print sheet P impacted to the surface of the damping plate 78 is directed to the discharge direction along the curved surface of the damping plate 78. Thereby, the kinetic energy of the print sheet P is gradually reduced. Further, the print sheet P drops along the curved face of the damping plate 78 and is led to the restricting faces 80. Thereby, the print sheet P is smoothly stacked on the paper mounting floor 72 while preventing spring back by the damping plate 78.

Further, as shown by FIG. 7 and FIG. 8, there may be constructed a constitution in which in the example of FIG. 3 and FIG. 4, the lower end portion 78B of the damping plate 78 is inserted slidably in the up and down directions to a receive portion (corresponding to holding portion) 88B having a section substantially in a shape of a channel directed upwardly at a lower portion of a support member 88*a*.

In this case, when the print sheet P is impacted to the damping plate 78, the damping plate 78 is elastically deformed in the discharge direction and the lower end portion 78B is lifted. Thereby, the damping plate 78 becomes easy to escape in the direction of discharging the print sheet P on the side of the space portion 92. Further, since the position of the lower end portion 78B of the damping plate 78 is held by the receive portion 88B, the print sheet P impacted to the damping plate 78 drops in a constant direction along the surface of the damping plate 78. Then, the print sheet P drops while the front end portion is being aligned along the restricting faces 80 and is stacked onto the paper mounting floor 72.

Figure 9:
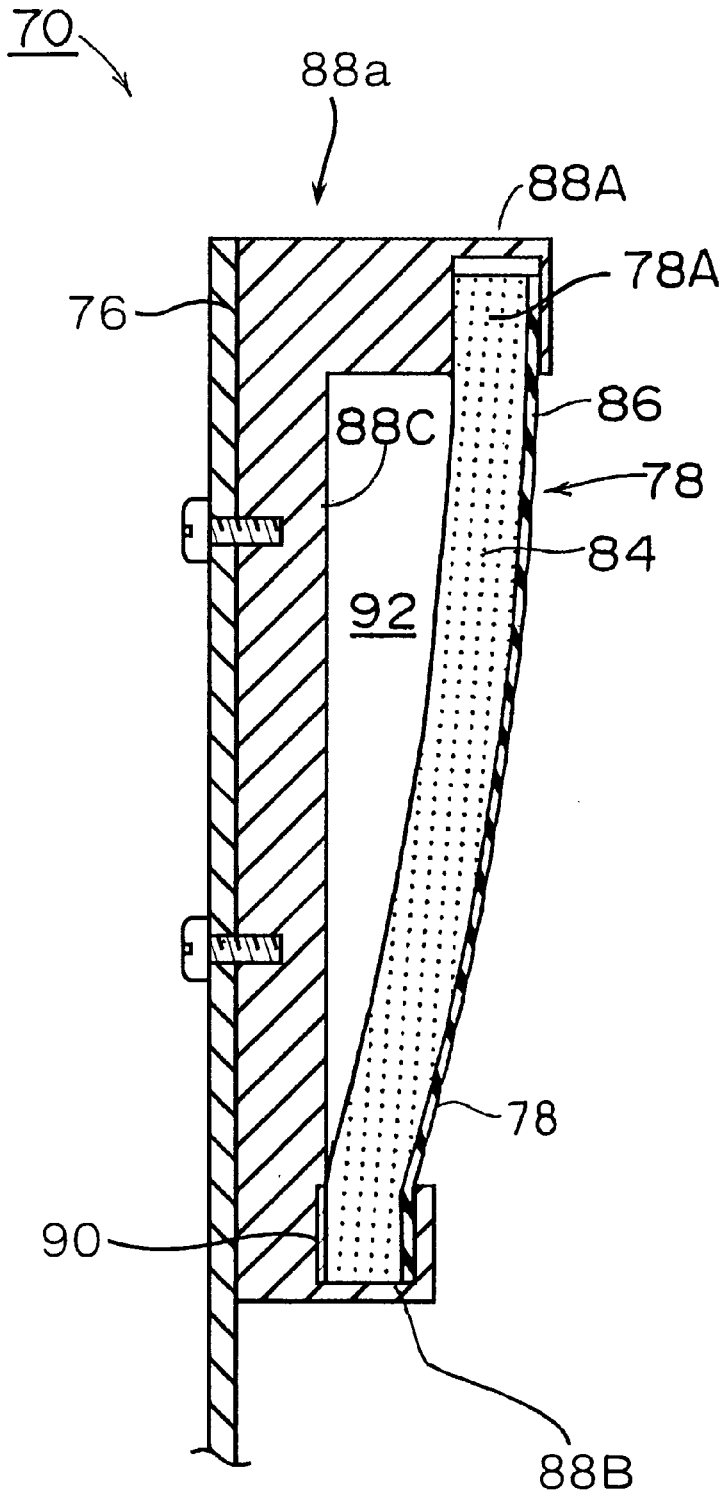
FIG. 9 is a sectional view of an impact wall taken along line 8,9—8,9 of FIG. 7 showing other modified example of the paper discharge base according to the second embodiment.

Further, as shown by FIG. 9, there may be constructed a constitution in which in the example of FIG. 3 and FIG. 4, the upper end portion 78*a* of the damping plate 78 may be inserted slidably in the up and down directions to a receive portion (corresponding to holding portion) 88C having a section substantially in a shape of a channel directed upwardly at an upper portion of the support member 88*a*.

In this case, when the print sheet P is impacted to the damping plate 78, the damping plate 78 is elastically deformed in the discharge direction and the upper end portion 78A is lowered. Thereby, the damping plate 78 becomes easy to escape in the direction of discharging the print sheet P constituting the side of the space portion 92. Further, since the position of the upper end portion 78A of the damping plate 78 is held by the receive portion 88C, the print sheet P impacted to the damping plate 78 drops in the constant direction along the surface of the damping plate 78. Then, the print sheet P drops while the front end edge portion is being aligned along the regulating faces 80 and is stacked onto the paper mounting floor 72.

Next, an explanation will be given to the third embodiment of the present invention. Portions same as those in the first and the second embodiments are attached with the same notations and an explanation thereof will be omitted. As shown by FIG. 10 through FIG. 14, this example is an example in which in the second embodiment shown by FIG. 5 and FIG. 6, there is provided position adjusting means for freely adjusting the position of the damping plate 78 in the up and down directions.

As shown by FIG. 10 through FIG. 14, the damping plate 78 is supported by the impact wall main body 76 by being attached to a slider 88*b*. According to the damping plate 78, the upper end portion 78A is adhered to a support portion 88A formed to project to an upper portion of the slider 88*b* by the double face adhering tape 90.

Figure 10:
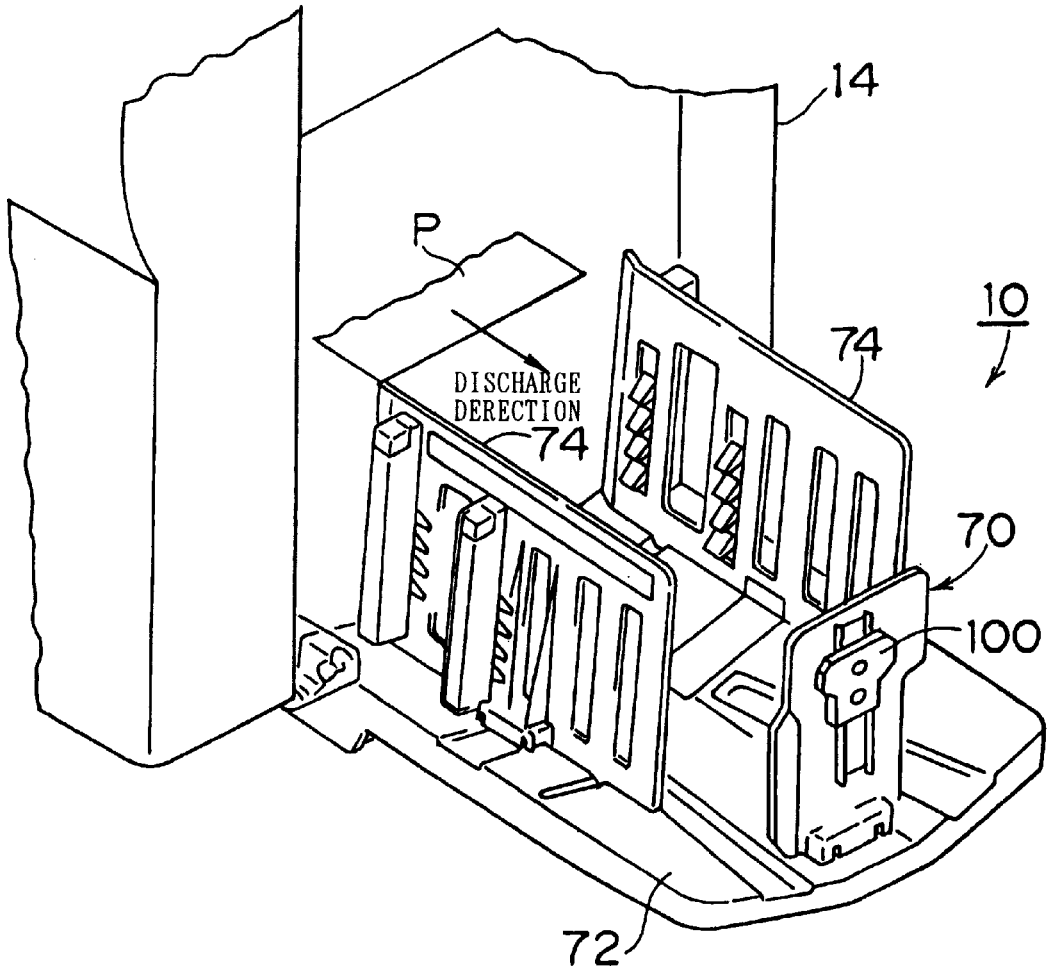
FIG. 10 is a perspective view of the paper discharge base according to the third embodiment.
Figure 11:
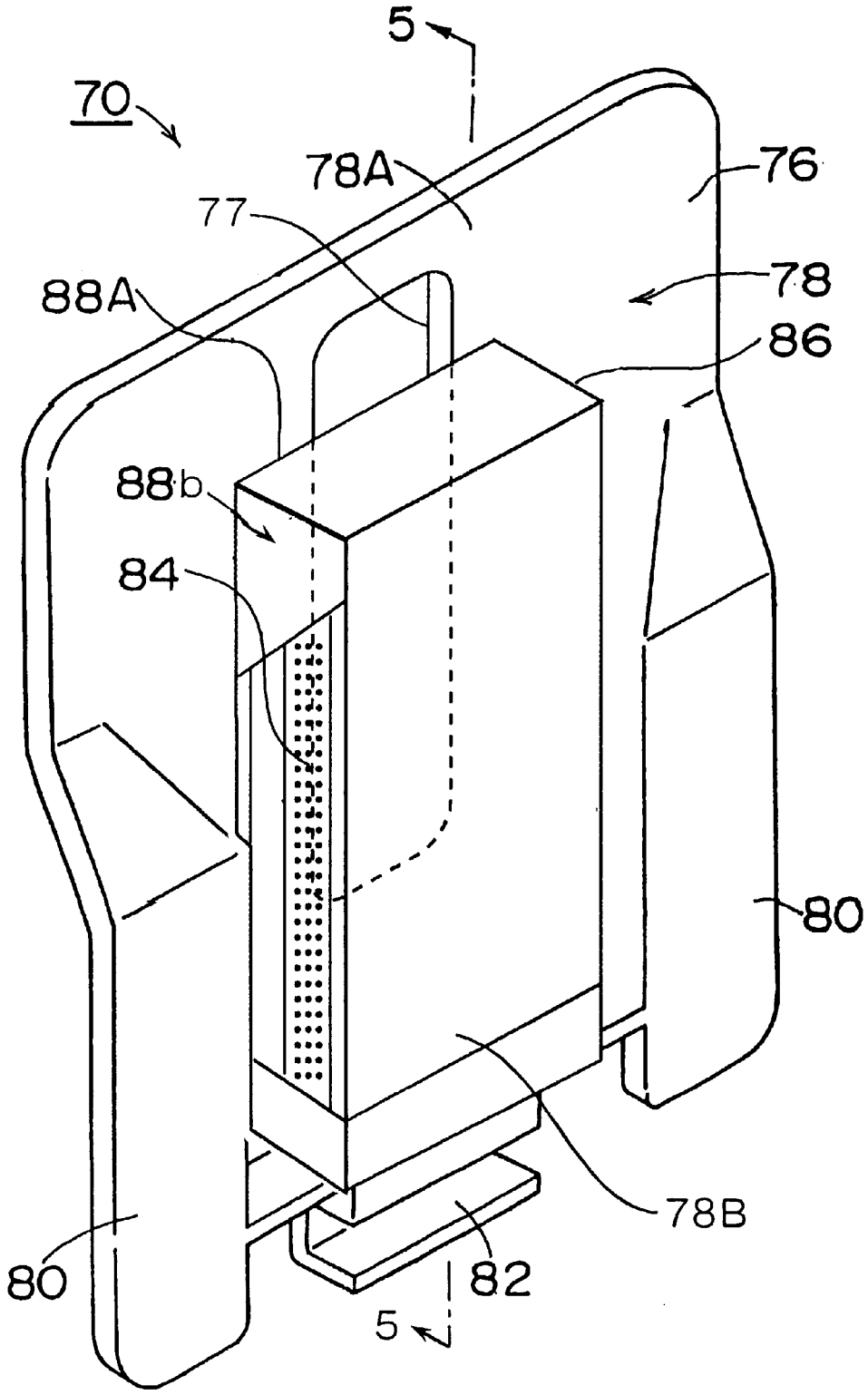
FIG. 11 is a front perspective view showing a state in which the damping plate of the paper discharge base according to the third embodiment is positioned at a lower position.

The slider 88*b* is arranged slidably in the up and down directions along a slit 77 shown in FIG. 11 formed at the impact wall main body 76. Further, a height position of the slider 88*b* is adjusted by a position adjusting mechanism 94 (refer to FIG. 10, FIG. 12, FIG. 14) provided on the rear face side of the impact wall main body 76. That is, by the position adjusting mechanism 94, the damping plate 78 can be moved to a position for effectively damping impact of the print sheet P.

Figure 12:
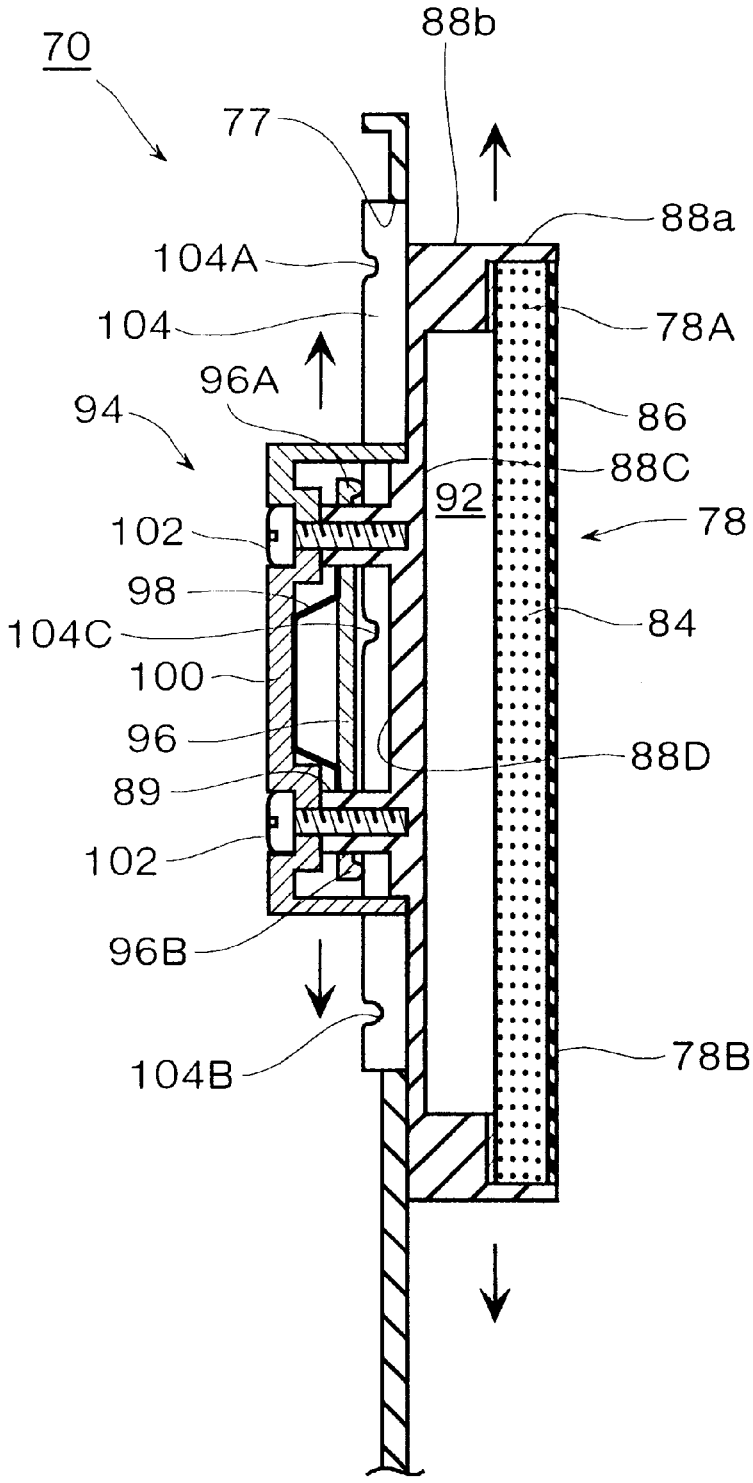
FIG. 12 is a sectional view of an impact wall taken along line 12—12 of FIG. 11 in the paper discharge base according to the third embodiment.
Figure 13:
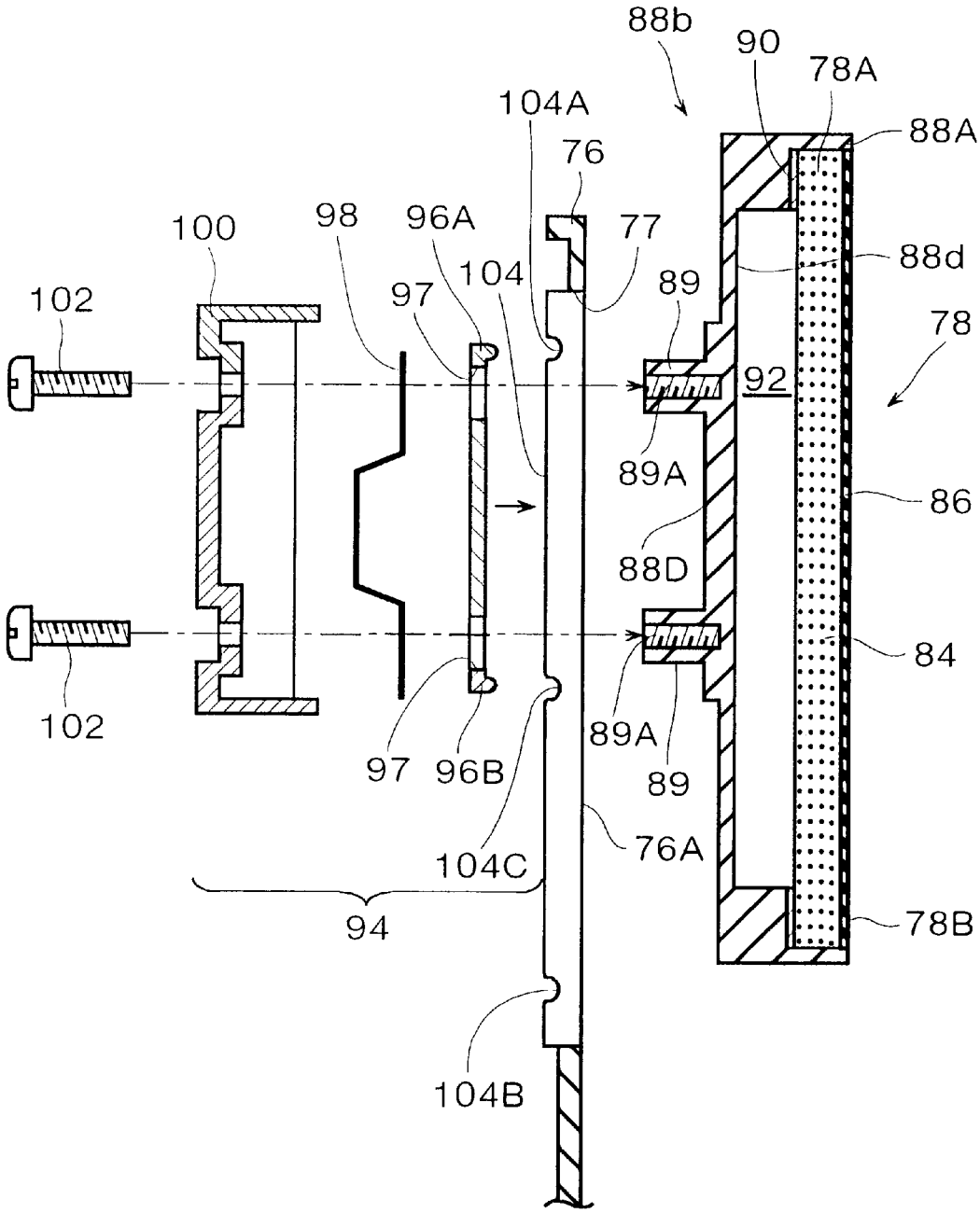
FIG. 13 is a view of integrating a position adjusting mechanism of the paper discharge base according to the third embodiment.

As shown by FIG. 12 and FIG. 13, the position adjusting mechanism 94 is constituted by a claw plate 96, a leaf spring 98 and an operation knob 100. A pair of bosses 89 is formed at a rear face 88D of the slider 88*b*. The claw plate 96 and the leaf spring 98 are formed with holes 97 (holes of leaf spring 98 are not illustrated) for inserting the pair of bosses 89. The bosses 89 are perforated with screw holes 89A. The screw holes 89A are screwed with the setscrews 102 from an outer side of the operation knob 100. Thereby, the slider 88 and the operation knob 100 are connected to sandwich the impact wall main body 76 via the claw plate 96 and the leaf spring 98.

Further, the leaf spring 98 is elastically deformed by being sandwiched between the claw plate 96 per se and the operation knob 100. The claw plate 96 is urged to the rear face side of the impact wall main body 76 by urge force of the elastically deformed leaf spring 98.

On the rear face side of the impact wall main body 76, there is formed a pair of projected streak portions 104 along both sides of the slit 77. At upper portions of the projected streak portions 104, there are formed recess portions 104A to be engaged with upper claws 96A of the claw plate 96. Further, at lower portions of the projected streak portions 104, there are formed recess portions 104B to be engaged with lower claws 96B of the claw plate 96. Further, recess portions 104C are formed also at centers of the projected streak portions 104. When the upper claws 96A are engaged with the recess portions 104A, the recess portions 104C are engaged with the lower claws 96B. Further, the recess portions 104C are engaged with the upper claws 96A when the lower claws 96B are engaged with the recess portions 104B.

According to the position adjusting mechanism 94 constituted in this way, a click mechanism is constituted by the claws 96A and 96B and the recess portions 104A, 104B and 104C. By the click mechanism, the damping plate 78 is positioned at an upper position shown by FIG. 5 or a lower position shown by FIG. 11.

Figure 14:
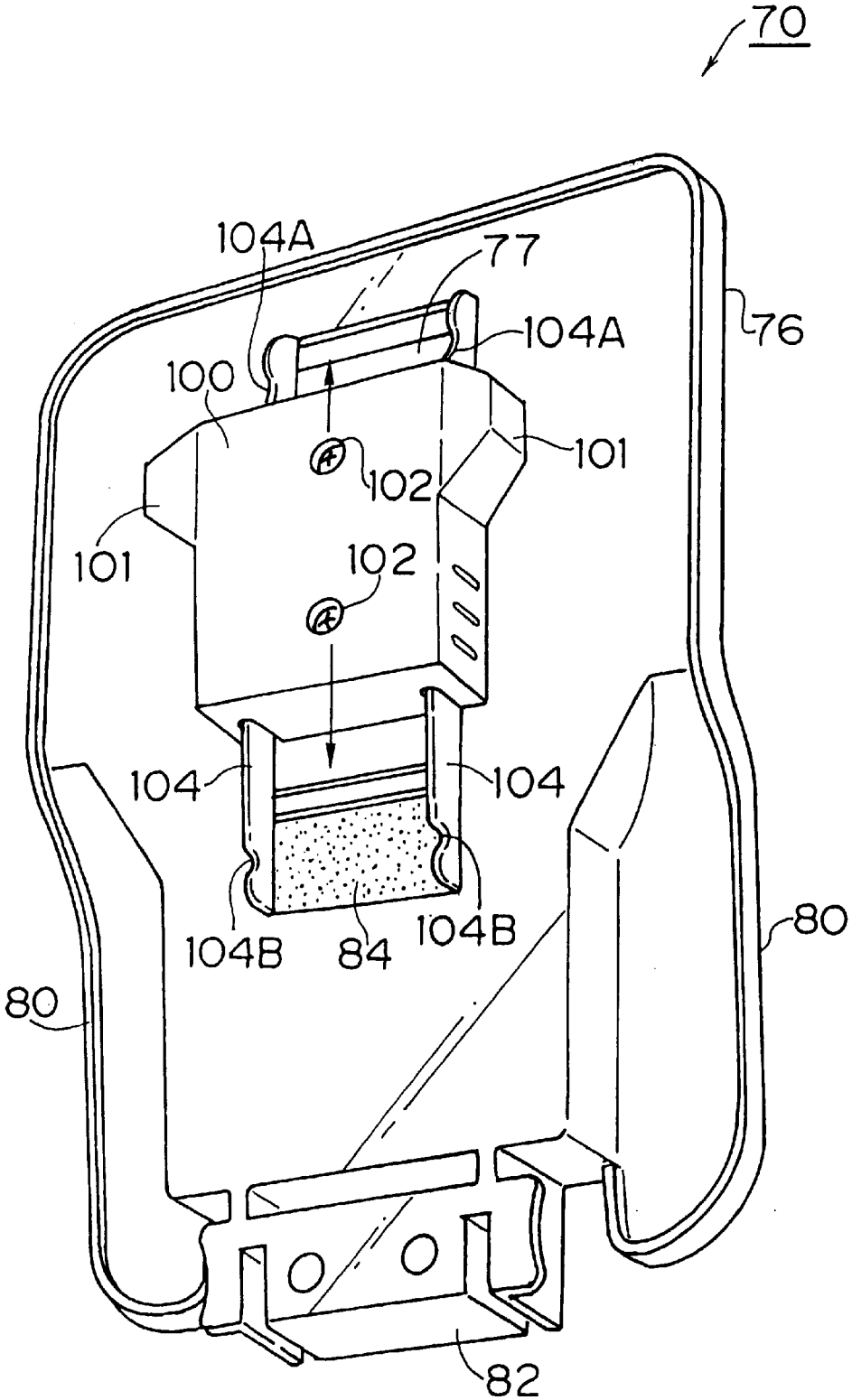
FIG. 14 is a rear perspective view of the paper discharge base according to the third embodiment.

Further, the slider 88*b* is pressed to the surface 76A of the impact wall main body 76 by the urge force of the leaf spring 98 to thereby provide pertinent friction. Therefore, the damping plate 78 can be positioned not only at the upper position shown by FIG. 5 or the lower position shown by FIG. 11 but also at an arbitrary position. Further, as shown by FIG. 10 and FIG. 14, on both side faces of the operation knob 100, there are formed projected portions 101 for pinching the operation knob 100 by the thumb and the forefinger.

An explanation will be given of operation of this example as follows. First, before starting printing operation, the paper discharge base 10 is installed at a predetermined position (position of FIG. 10) of the stencil printing machine 12. Further, the interval of the fences 74 is adjusted to align to the width of the print sheet P and a position of the impact wall 70 in the forward and rearward directions is adjusted to align to the length of the print sheet P.

Next, the height of the damping plate 87 of the impact wall 70 is adjusted by the position adjusting mechanism 94 and the damping plate 78 is positioned to a position of effectively damping impact of the print sheet P. For example, in case of the light print sheet P, the damping plate 78 is positioned to the upper position shown by FIG. 5. Conversely, in case of the heavy print sheet P, the damping plate 78 is positioned to the lower position shown by FIG. 11. Further, as shown by FIG. 12, depending on the weight of the print sheet P, the upper claw 96A is positioned between the recess portions 104A and the recess portions 104C and the lower claw 96B is disposed between the recess portions 104C and the recess portions 104B. Thereby, the damping plate 78 can be positioned to a predetermined position.

Further, after the printed print sheet P is separated from the printing drum 16 by the sheet separator claw 34, the print sheet P is then discharged to the paper discharge base 10 by the transfer belt 36. As shown by the first embodiment, the discharged print sheet P is stacked on the paper mounting floor 72 in the state in which the front end edge portion is aligned and contained.

Figure 15:
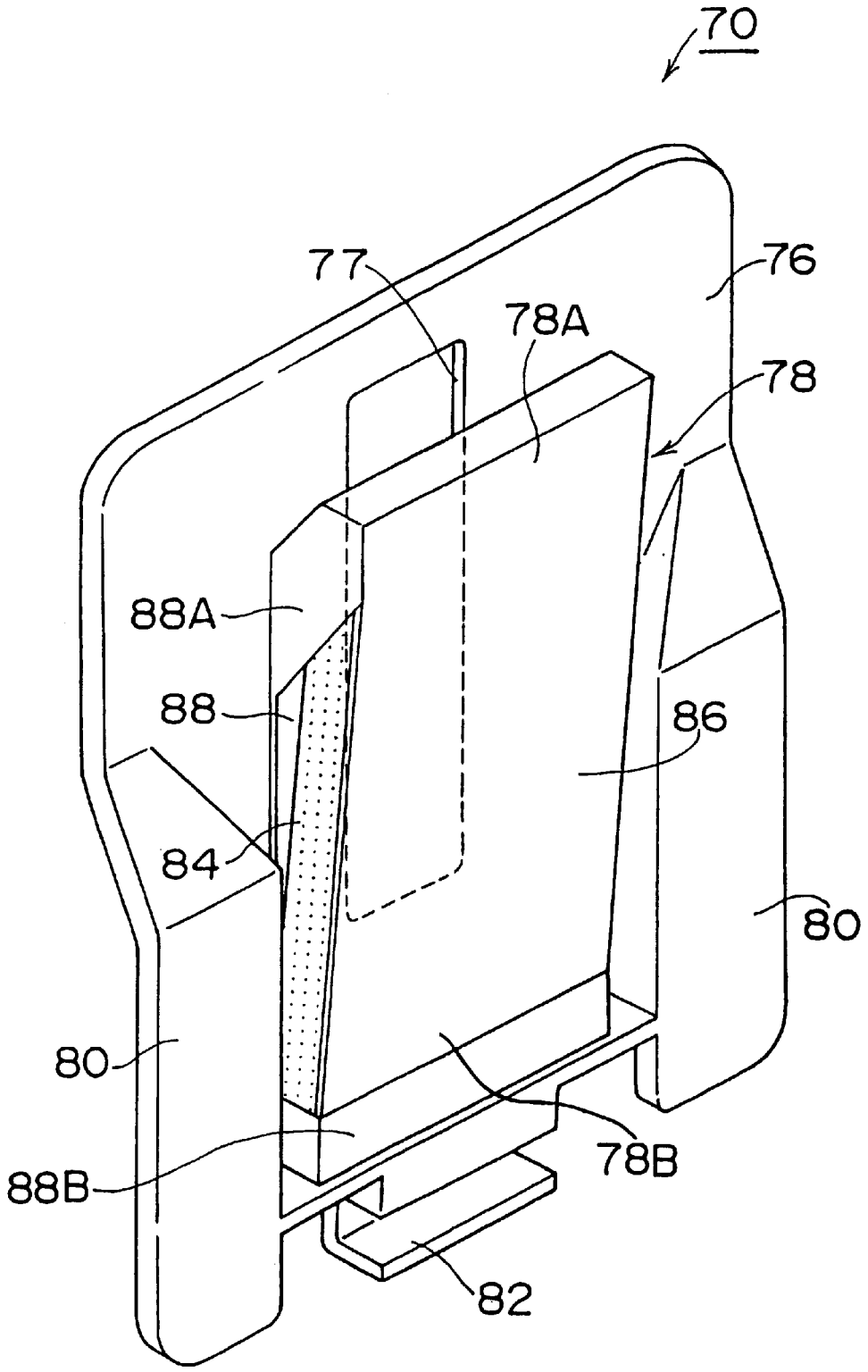
FIG. 15 is a front perspective view showing a state in which a damping plate is positioned at a lower position in a modified example of the paper discharge base according to the third embodiment.
Figure 16:
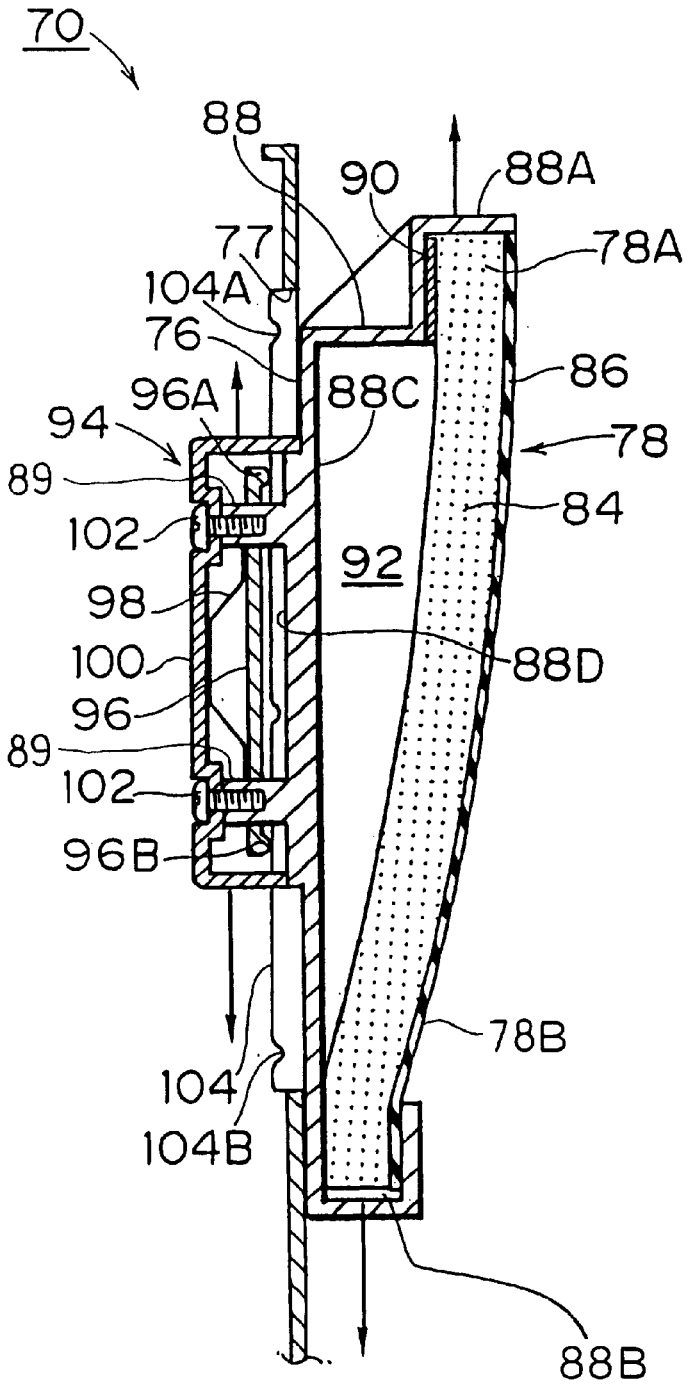
FIG. 16 is a sectional view of an impact wall similar to FIG. 7 in the modified example of the paper discharge base according to the third embodiment.
Figure 17:
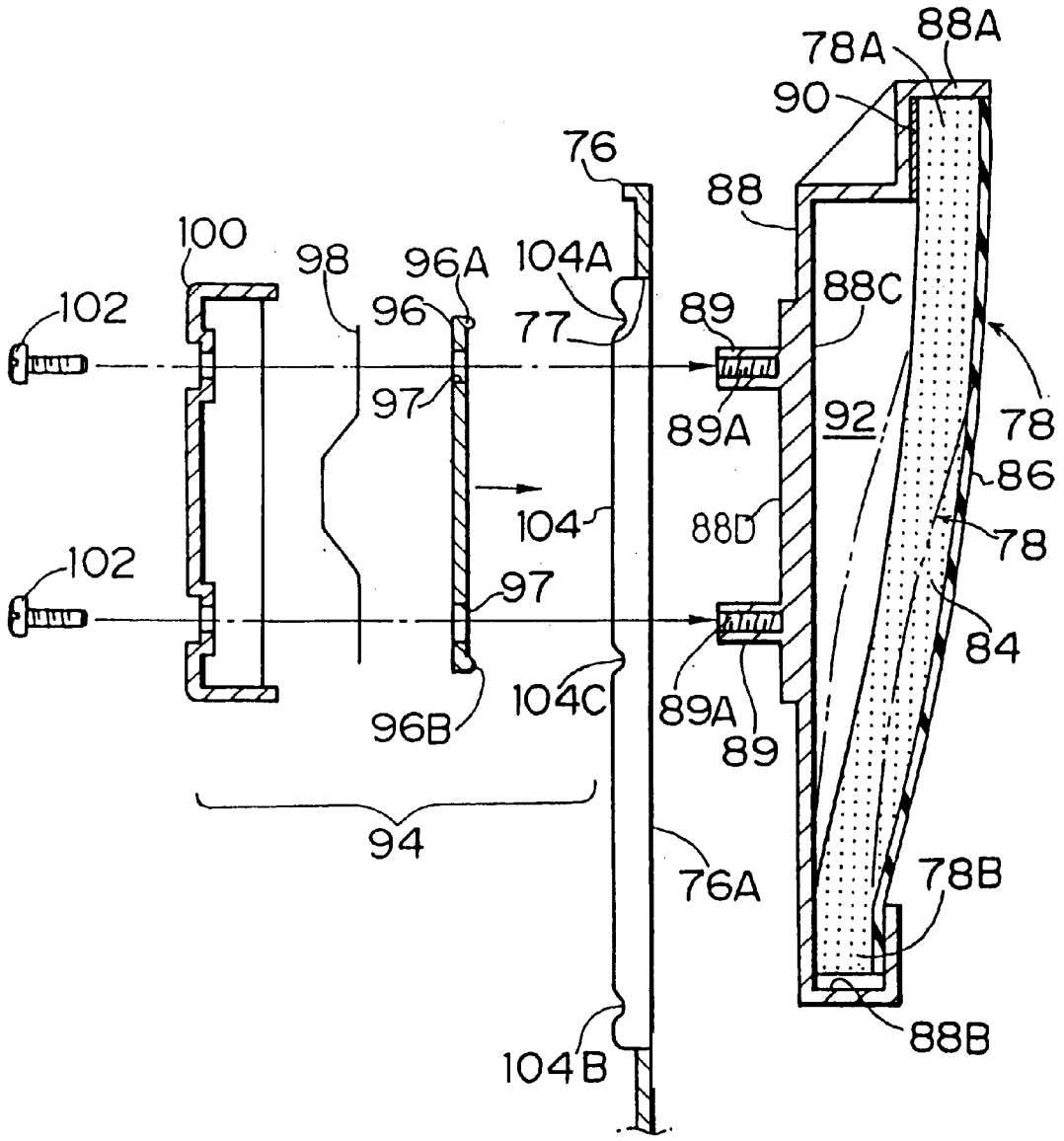
FIG. 17 is a view of integrating a position adjusting mechanism in the modified example of the paper discharge base according to the third embodiment.

Further, this example is applicable also to the example shown in the second embodiment (refer to FIG. 7 and FIG. 8) in which as shown by FIG. 15 through FIG. 17, the lower end portion 78B of the damping plate 78 is provided in the direction of discharging the print sheet P relative to the upper end portion 78A of the damping plate 78.

Further, as shown by FIG. 15 through FIG. 17, the example is applicable also to the example shown in the second embodiment (refer to FIG. 7 and FIG. 8) in which the lower end portion 78B of the damping plate 78 is inserted slidably in the up and down directions to the receive portion (corresponding to holding portion) 88B having the section substantially in the shape of a channel directed upwardly at the lower portion of the support member 88*a*.

Figure 18:
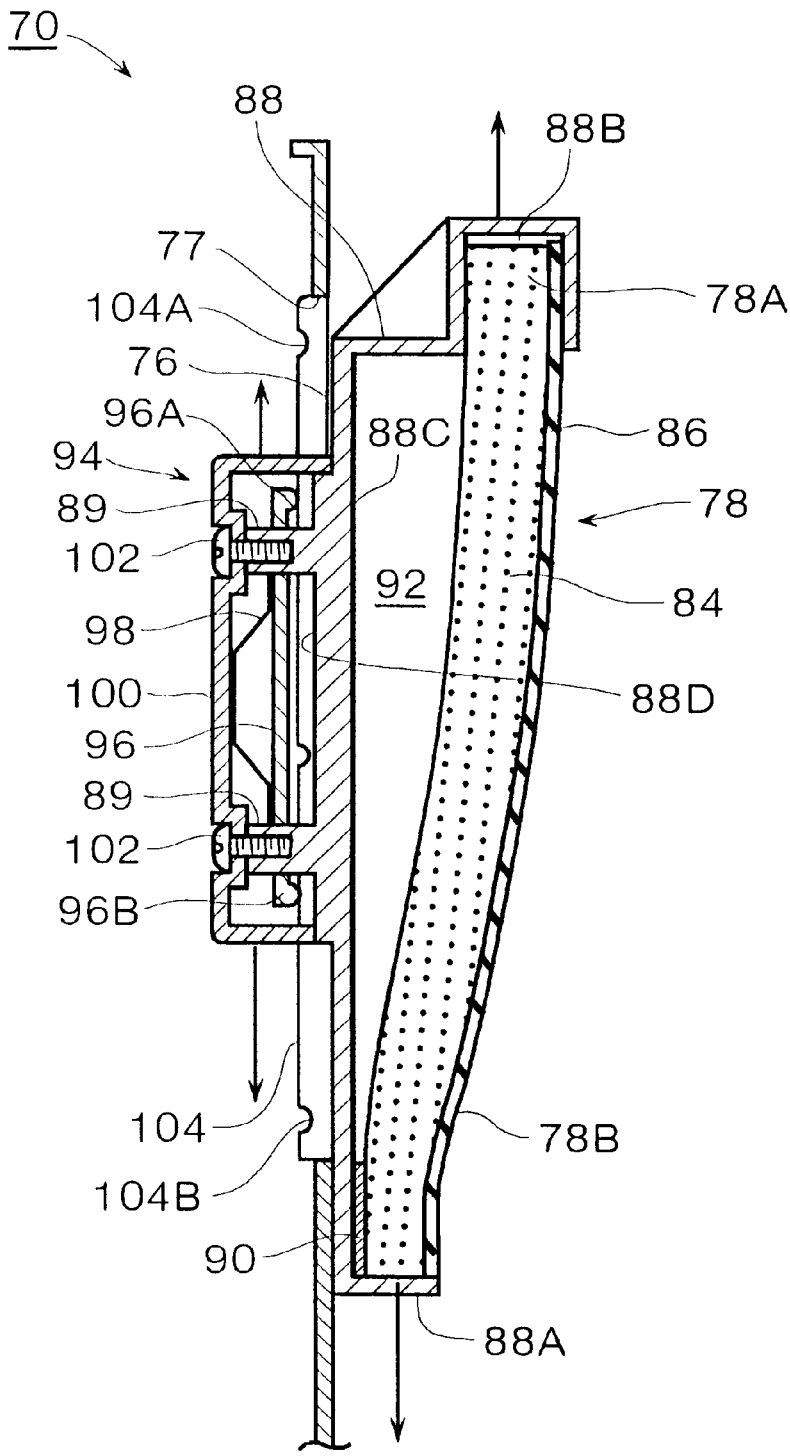
FIG. 18 is a sectional view of an impact wall similar to FIG. 7 in other modified example of the paper discharge base according to the third embodiment.

Further, as shown by FIG. 18, the example is applicable also to the example shown in the second embodiment (refer to FIG. 7 and FIG. 8) in which the upper end portion 78A of the damping plate 78 is inserted slidably in the up and down directions to the receive portion (corresponding to holding portion) 88B having the section substantially in the shape of a channel directed downwardly at the upper portion of the support member 88*a*.

In this way, according to the third embodiment, by the position adjusting mechanism 94, in correspondence with the paper quality of the print sheet P, the damping plate 78 is previously disposed at the position of effectively damping impact of the print sheet P. Therefore, impact sound when the print sheet P is impacted to the damping plate 78 can significantly be alleviated.

Further, the position adjusting mechanism 94 is provided with the click mechanism for positioning the damping member 78 to predetermined positions. Therefore, the position of the damping member 78 can be made to easily correspond to the height of impact of the print sheet having predetermined paper quality.

Further, although according to the embodiment, a description has been given to an example in which the paper discharge base 10 is applied to the stencil printing machine 12 constituting the printing apparatus, the paper discharge base 10 of the present invention is not limited to the printing apparatus but is applicable to a copying apparatus.

As has been explained above, according to the first aspect of the present invention, impact force of a print sheet is transmitted from the protection sheet to the sponge sheet and can be damped by the sponge sheet. Further, the sponge sheet is protected by the protection sheet and accordingly, durability against impact of the print sheet can be promoted.

Further, according to the second aspect of the present invention, strength of the protection sheet is promoted, thereby, the damping operation of the sponge sheet can be promoted by thinning the protection sheet. Further, the sponge sheet can sufficiently be protected against impact force of the print sheet. Further, by the property in which the surface is smooth, the print sheet impacted to the protection sheet can smoothly be made to drop along the surface of the protection sheet.

Further, according to the third aspect of the present invention, in a state in which the front end edge portions of the print sheet are aligned, the dropping print sheets can successively be stacked on the paper mounting floor and the sheets can be aligned excellently. Thereby, there is eliminated time and labor of aligning print sheets after taking out the print sheets from the paper discharge base.

Further, according to the fourth aspect of the present invention, the damping member is elastically deformed and escaped in the direction of discharging the print sheet constituting the side of the space portion. Thereby, impact sound of the print sheet and spring back of the print sheet caused by impact can be alleviated.

Further, according to the fifth aspect of the present invention, the surface of the damping member is formed in a shape of a gradually curved face inclined in the direction of discharging the print sheet gradually from an upper end portion to a lower end portion thereof. Kinetic energy of the print sheet can be reduced gradually by directing the print sheet impacted to the surface of the damping member in the discharge direction along the curved surface of the damping member. Thereby, spring back of the print sheet caused by the damping member can be prevented further effectively.

Further, according to the sixth aspect of the present invention, the damping member impacted with the print sheet is elastically deformed and escaped to the side of the space portion with the upper end (lower end) as a fulcrum and accordingly, by a simple constitution, sound pacifying formation of the impact sound of the print sheet can be achieved. Thereby, the sheet can be aligned excellently by alleviating spring back of the print sheet caused by impact.

Further, the lower end portion (upper end portion) of the damping member is held at a holding portion on the side of the impact wall slidably in the up and down directions and accordingly, the damping member becomes easy to escape in the direction of discharging the print sheet (side of the space portion). Thereby, the print sheet impacted to the damping member can be dropped in a constant direction along the surface of the damping member.

Further, according to the seventh aspect of the present invention, the damping member can be disposed at a position capable of damping effectively the impact of the print sheet.

Further, according to the eighth aspect of the present invention, by a click mechanism, the position of the damping member can be made to correspond easily to impact height of the print sheet having predetermined paper quality.

What is claimed is:

1. A paper discharge base of an image forming apparatus comprising:

an impact wall impacted by a print sheet discharged from a printing section and having an impact position;

a damping member provided on a surface of the impact wall for damping impact caused by impacting the print sheet, said damping member being formed of a sponge sheet and a protection sheet attached to a surface of the sponge sheet impacted by the print sheet, and including an upper end portion, a space portion on a rear face side of the impact position, and a lower end portion provided in a direction of discharging the print sheet relative to the upper end portion, one of the upper and lower end portions being fixed to a side of the impact wall and the other of the upper and lower end portions being held slidably in up and down directions relative to the side of the impact wall; and a paper mounting floor loaded with the print sheet which has been impacted to the damping member and drops.

2. The paper discharge base of an image forming apparatus according to claim 1, wherein the protection sheet of the damping member is made of polyethylene terephthalate.

3. The paper discharge base of an image forming apparatus according to claim 1, further comprising: regulating portions projected from a portion of the damping member on a lower side of the impact position to a side of an apparatus main body on two sides of the impact wall formed on the lower side of the impact position at which the print sheet is impacted to the damping member for leading a front end edge portion of the print sheet dropping to the lower side while being brought into sliding contact therewith.

4. The paper discharge base of an image forming apparatus according to claim 1, further comprising: position adjusting means provided at the impact wall and capable of adjusting a position of the damping member in the up and down directions.

5. A paper discharge base of an image forming apparatus comprising:

an impact wall impacted by a print sheet discharged from a printing section having an impact position;

a damping member provided on a surface of the impact wall for damping impact caused by impacting the print sheet, said damping member being formed of a sponge sheet and a protection sheet attached to a surface of the sponge sheet impacted by the print sheet, and having a space portion on a rear face side of the impact position;

position adjusting means provided at the impact wall and capable of adjusting a position of the damping member in up and down directions, said position adjusting means including a click mechanism for positioning the damping member to a predetermined position in the up and down directions; and a paper mounting floor loaded with the print sheet which has been impacted to the damping member and drops.

* * * * *